US008021020B2

(12) United States Patent
Costello et al.

(10) Patent No.: US 8,021,020 B2
(45) Date of Patent: Sep. 20, 2011

(54) LIGHTED ARCHITECTURAL MESH

(75) Inventors: Thomas Costello, Annapolis, MD (US); Matthew O'Connell, Easton, MD (US); Bassam Dib Jalbout, Mont-Royal (CA)

(73) Assignees: Cambridge International Inc., Cambridge, MD (US); LSI Industries, Inc., Cincinnati, OH (US)

( * ) Notice: Subject to any disclaimer, the term of this patent is extended or adjusted under 35 U.S.C. 154(b) by 66 days.

(21) Appl. No.: 12/218,385

(22) Filed: Jul. 15, 2008

(65) Prior Publication Data

US 2009/0021939 A1 Jan. 22, 2009

Related U.S. Application Data

(60) Provisional application No. 61/075,199, filed on Jun. 24, 2008, provisional application No. 60/929,862, filed on Jul. 16, 2007.

(51) Int. Cl.
*F21V 21/00* (2006.01)

(52) U.S. Cl. ..... 362/249.15; 362/249.06; 362/806

(58) Field of Classification Search ..... 362/249.01, 362/249.02, 249.03, 249.04, 249.06, 249.07, 362/249.08, 249.14, 249.15, 249.16, 391, 362/806

See application file for complete search history.

(56) References Cited

U.S. PATENT DOCUMENTS

| | | | |
|---|---|---|---|
| 3,278,784 | A | 10/1966 | Masaharu |
| 4,001,778 | A | 1/1977 | Ross |
| 4,234,907 | A | 11/1980 | Daniel |
| 4,625,140 | A | 11/1986 | Gagnon |
| 4,752,114 | A | 6/1988 | French |
| 4,907,132 | A | 3/1990 | Parker |
| 4,912,889 | A | 4/1990 | Palumbo |
| 5,021,928 | A | 6/1991 | Daniel |
| 5,601,361 | A | 2/1997 | Lawrence |
| 5,709,462 | A | 1/1998 | Rumpel |
| 5,772,311 | A | 6/1998 | Williams et al. |
| 5,839,820 | A | 11/1998 | Huang |
| 5,900,850 | A | 5/1999 | Bailey et al. |
| 5,924,786 | A | 7/1999 | Lin |

(Continued)

FOREIGN PATENT DOCUMENTS

CA 2 306 683 10/2001

(Continued)

OTHER PUBLICATIONS

OCZ's HydroJet On Screen™ WayCool™ Technology showcased at shows including Computex 2007 and CeBit 2007 in the operations prototype of HydroJet, OCZ's revolutionary CPU cooling system, View the HydroJetDescription.pdf; Http://www.onscreentech.com/index.php.

(Continued)

*Primary Examiner* — Y My Quach Lee
(74) *Attorney, Agent, or Firm* — Cohen Pontani Lieberman & Pavane LLP

(57) ABSTRACT

A lighted architectural mesh includes a plurality of interconnected wires forming a plurality of transverse openings. At least one light carrier is slidably received within at least one of said transverse openings. The at least one light carrier includes light nodes emitting light through the interstices on the front and/or rear side of the architectural mesh. The at least one light carrier further comprises a plurality of connecting elements, wherein the light emitter nodes of the at least one light element are releasably interconnected in series by the connecting elements.

38 Claims, 13 Drawing Sheets

U.S. PATENT DOCUMENTS

| | | | | |
|---|---|---|---|---|
| 5,962,967 | A | 10/1999 | Kiryuschev et al. | |
| 6,072,619 | A | 6/2000 | Kiryuschev et al. | |
| 6,152,576 | A | 11/2000 | Mount | |
| 6,237,290 | B1 | 5/2001 | Tokimoto et al. | |
| 6,302,561 | B1 | 10/2001 | Huang | |
| 6,438,298 | B1 | 8/2002 | Matsui et al. | |
| 6,490,402 | B1 | 12/2002 | Ota | |
| 6,575,595 | B1 | 6/2003 | Wu | |
| 6,608,438 | B2 | 8/2003 | Topelberg et al. | |
| 6,624,565 | B2 | 9/2003 | Topelberg | |
| 6,697,191 | B2 | 2/2004 | Kiryuschev et al. | |
| 6,793,360 | B2 | 9/2004 | Goslee | |
| 7,072,567 | B2 | 7/2006 | Hammers | |
| 7,105,858 | B2 | 9/2006 | Popovich | |
| 7,144,748 | B2 | 12/2006 | Popovich | |
| 7,144,830 | B2 | 12/2006 | Hill et al. | |
| 7,374,315 | B2 * | 5/2008 | Dorsey et al. | 362/249.01 |
| 2002/0001731 | A1 | 1/2002 | Kufferath | |
| 2002/0074937 | A1 | 6/2002 | Guberman et al. | |
| 2002/0187697 | A1 | 12/2002 | Kiryuschev et al. | |
| 2003/0006693 | A1 | 1/2003 | Topelberg | |
| 2004/0047142 | A1 | 3/2004 | Goslee | |
| 2005/0218797 | A1 | 10/2005 | Bechtel et al. | |
| 2005/0237741 | A1 * | 10/2005 | Chang | 362/249.01 |
| 2006/0039142 | A1 | 2/2006 | Temple | |
| 2007/0044357 | A1 | 3/2007 | Biondo et al. | |
| 2007/0070626 | A1 | 3/2007 | Deguara | |
| 2007/0144101 | A1 | 6/2007 | Costello | |
| 2007/0182666 | A1 | 8/2007 | Hochman et al. | |
| 2007/0197115 | A1 | 8/2007 | Eves et al. | |
| 2008/0002389 | A1 | 1/2008 | Kufferath-Kassner et al. | |

FOREIGN PATENT DOCUMENTS

| | | |
|---|---|---|
| DE | 33 32 536 | 3/1985 |
| DE | 299 06 622 | 8/1999 |
| DE | 100 65 695 | 7/2002 |
| DE | 10 2004 050 838 | 4/2006 |
| EP | 0 997 865 | 5/2000 |
| JP | 05 106372 | 4/1993 |
| WO | WO 2004/019657 | 3/2004 |
| WO | WO 2006/128447 | 12/2006 |

OTHER PUBLICATIONS

On Screen Technologies "OnScreen provides Cool Solutions to Hot Problems", Http://www.onscreentech.com/index.php.

GKD Illumesh webpage Oct. 28, 2008 http://www.gkdmetalfabrics.com/ProductDetail.aspx?ID=39b.

GKD Illumesh and Mediamesh Brochure 2006.

* cited by examiner

LIGHTED ARCHITECTURAL MESH

CROSS-REFERENCE TO RELATED APPLICATIONS

The present application claims priority to U.S. Provisional Application 60/929,862, filed on Jul. 16, 2007, and to U.S. Provisional Application 61/075,199, filed Jun. 24, 2008, the entire contents of which are incorporated herein by reference.

BACKGROUND OF THE INVENTION

1. Field of the Invention

The present invention relates to an architectural metallic mesh, and more particularly, to an architectural metallic mesh having a light carrier therein, and a method of making the same.

2. Description of the Prior Art

Architectural metallic meshes are generally used in commercial and business environments to provide elegant wall panels, doors and other surfaces whenever an aesthetic appearance of polish and prestige are of primary importance. Architectural mesh is also an excellent choice for high contact areas, such as the interior walls of elevator cabs, escalator walls, and sales and reception areas, because it is generally scratch, dent and corrosion resistant. As such, architectural metallic mesh maintains a stunning appearance with minimal maintenance.

Woven into panels from brass, stainless steel, copper, and/or other desired metals or alloys, architectural mesh offers a richness of texture, pattern and color that cannot be duplicated by any other material. Architectural mesh can also be polished, finished and combined with different background colors to create a custom look and configuration. Depending upon the chosen weave, the interstices or apertures between the weft or fill wires and the warp wires may allow light to pass through the architectural mesh. Alternatively, if the weave is tight and the wires are more closely adjacent to one another, the passage of light through the mesh will be selectively prevented. Accordingly, as the requirement for incorporating energy savings into building design increases, and hence the need for architecturally acceptable sun shading or screening, architectural mesh offers a variety of options that can meet the shading needs of buildings while still maintaining architectural requirements. Architectural mesh panels can also be used to provide protection from the wind and other elements such as, for example, in a parking garage where the exterior walls are only several feet high on each level, thus leaving a several foot open area through which rain, hail, and sleet can enter the garage.

U.S. Pat. No. 6,793,360 assigned to Cambridge International Inc., discloses an example of an architectural mesh panel wherein a light carrier is interwoven with the plurality of wires in the mesh. The result is an attractive and decorative mesh panel with accent light effects therethrough. The type of mesh panel disclosed in that patent includes woven weft and fill wires and the light carrier is substituted for one of the weft wires during the manufacture of the mesh.

While this type of interweaving securely holds the light carrier in place, repair or replacement of the light carrier is quite difficult and labor intensive.

Accordingly, it would be desirable to provide an architectural mesh having a light or lighted carrier therein, so as to create a greater aesthetic appeal in environments benefited by the presence of accent lighting, wherein the light carrier is more readily accessible and/or replaceable as desired.

SUMMARY OF THE INVENTION

The present invention provides an architectural mesh comprising a plurality of spiral wires, wherein said wires are interconnected to form a mesh defining a plurality of transverse openings, and at least one light carrier is slidably received within at least one of said transverse openings.

An architectural mesh according to an embodiment of the present invention includes a mesh having a plurality of interconnected wires and at least one light carrier. The mesh having opposing front and rear sides and transverse openings. Furthermore, the mesh is an open mesh having interstices between the interconnected wires on the front and rear sides. The at least one light carrier is slidably received in one of the transverse openings and the at least one light carrier having a plurality of light emitter elements emitting light through the interstices in the mesh on at least one of the front and rear sides.

Each of the light emitter elements corresponds to one of said interstices. Furthermore, each of the light emitters comprises a plurality of light emitting pixels arranged in a pattern corresponding to a shape of the one of the interstices. The light emitting pixels comprise Light Emitting Diodes (LEDs). According to one embodiment of the mesh, the pattern is a parallelogram shape.

The at least one light carrier further comprises a plurality of connecting elements, wherein the plurality of light emitter elements of the at least one light carrier are releasably interconnected in series by the connecting elements. Each of the light emitter elements is arranged in a separate emitter node. Each of the connecting elements comprises electrical conductors and two connectors arranged on opposing ends of the electrical conductors, each connector being releasably connectable to one of the plurality of light emitter nodes, whereby each of the connecting elements and each of the plurality of light emitter nodes of said at least one light carrier is separately replaceable. The electrical conductors may comprise wires, bus bars, or any other known or hereafter developed electrical conductors. In a preferred embodiment, the connecting element comprises an electrical conductor cable with connectors arranged on opposing ends.

In the embodiment in which the light emitter elements are each arranged in a separate light emitter node, each of the light emitter nodes is oval-shaped to facilitate insertion into the transverse openings.

According to another embodiment of the present invention, the interconnected wires of the mesh include helically wound spiral wires, the transverse openings comprising the opening along the longitudinal axis of the helically wound spiral wires. In this case, the interstices on the front and rear sides of the mesh are formed between each turn of the spiral wire.

In yet another embodiment, the mesh includes at least one clip for securing the at least one light emitter node to the mesh. The clip is a C-shaped clip having two ends and a center section between the two ends, the two ends being connectable to a top and bottom of one of said emitter nodes with the center of two clips being arranged laterally adjacent opposing sides of a section of one of the wires of the mesh panel. This arrangement prevents lateral movement by interference between the center section of the clip and the section of one of the wires.

Each light carrier includes first sections between the light emitter nodes that have a thinner profile than second sections that include the light emitting nodes. The thinner profile allows the visibility through the mesh in the area of the transverse opening to be occluded less by the first sections than by the second sections.

The object of the present invention is met by a method of making an architectural mesh according to an embodiment of the present invention including the step of providing a mesh of interconnected wires, the mesh having opposing front and rear sides and transverse openings, said mesh being an open mesh having interstices between the interconnected wires on the front and rear sides, and inserting at least one light carrier in a respective transverse opening, the at least one light carrier having light emitter elements arranged to emit light through the interstices on one of the front and rear sides of the mesh.

The at least one light carrier is assembled by interconnecting the light emitter nodes with connecting elements. A required length between adjacent light emitter nodes is determined and a length of the connecting elements is selected from a plurality of predetermined lengths. Each of the predetermined lengths is designed so that each of the interconnected light emitting nodes is aligned with one of the interstices. The light emitter nodes are provided with a pattern of light pixels that corresponds to a shape of the interstices through which light is to be emitted. A stop element may be attached to the light carrier after the step of inserting to prevent further lateral movement of the at least one light carrier, the stop element being arranged within a thickness of the mesh between the front and rear sides of the mesh.

The object of the present invention is also met by an architectural mesh including a mesh having a plurality of interconnected wires and having opposing front and rear sides and transverse openings, the mesh being an open mesh having interstices between the interconnected wires on the front and rear sides, and at least one light carrier slidably received in one of the transverse openings. The at least one light carrier has a plurality of light emitter nodes emitting light through the interstices in the mesh on at least one of the front and rear sides and connecting elements. The plurality of light emitter nodes of the at least one light carrier are releasably interconnected in series by the connecting elements. Each of the connecting elements comprises electrical conductors and two connectors arranged on opposing ends of the electrical conductors, each connector being releasably connectable to one of said plurality of light emitter nodes. Each of the connecting elements and each of the plurality of light emitter nodes of the at least one light element is separately replaceable. Furthermore, the connecting carrier of the at least one light element have a thinner profile than the light emitter nodes of the at least one light carrier, such that visibility through the mesh in the area of the transverse opening is occluded less by said connecting elements than by said light emitter nodes.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE FIGURES

These, and other objects, features, and advantages of the present invention will become more readily apparent to those skilled in the art upon reading the following detailed description, in conjunction with the appended drawings in which.

DETAILED DESCRIPTION OF THE PRESENT INVENTION

Figure 1:
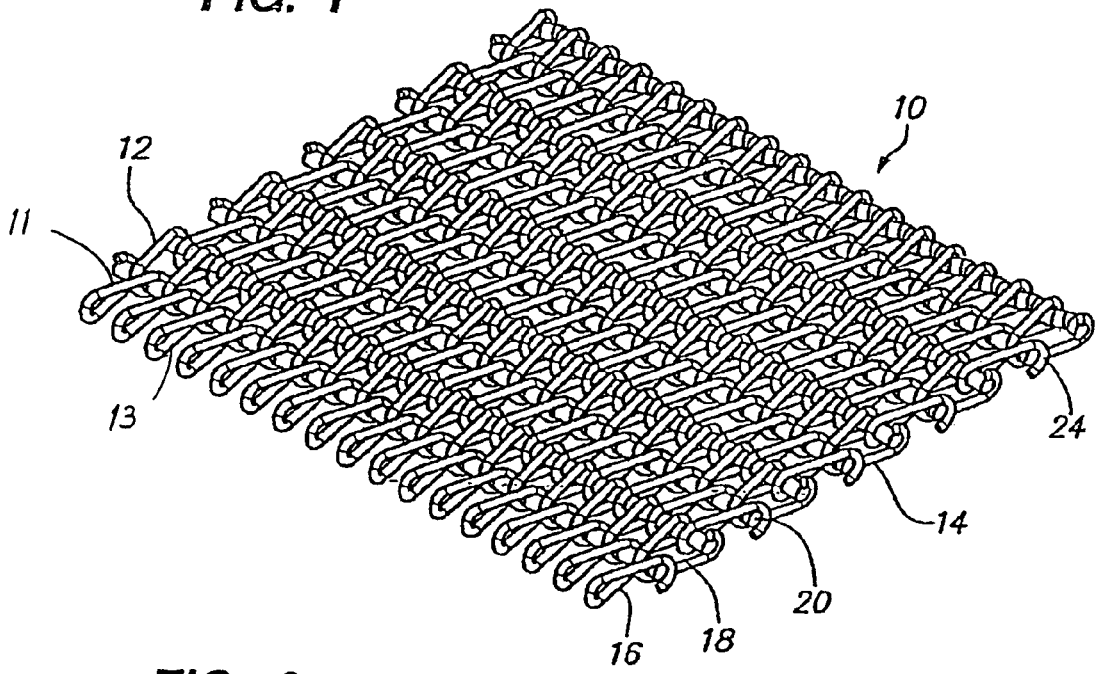
FIG. 1 is a top perspective view of a portion of an architectural mesh panel in accordance with the principles of the present invention.
Figure 2:
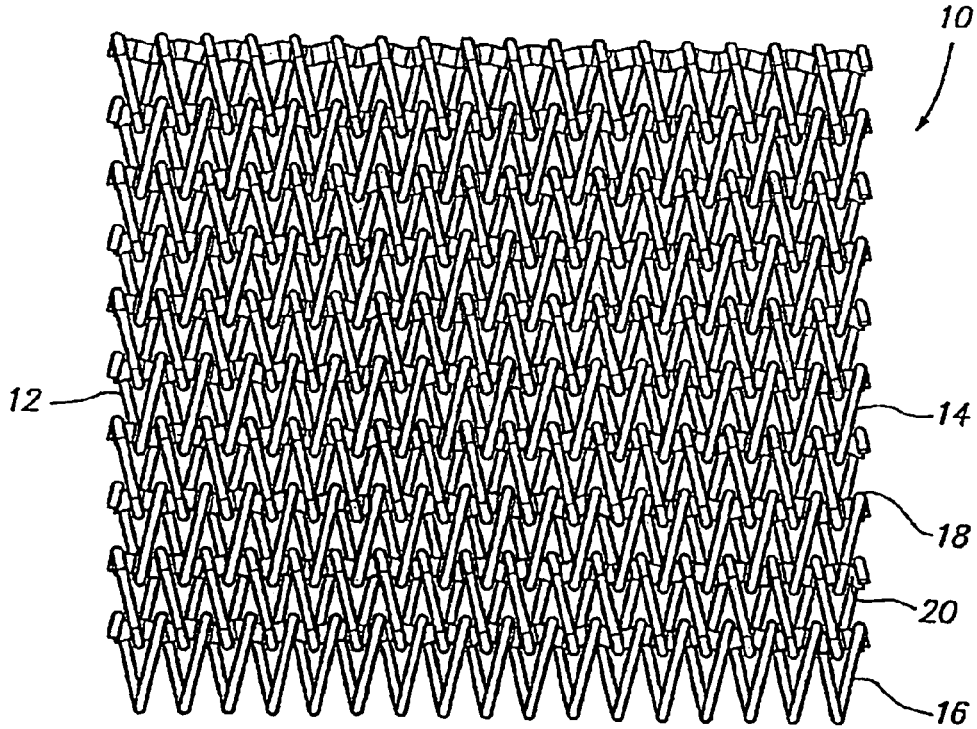
FIG. 2 is a top plan view of the architectural mesh panel of FIG. 1.
Figure 3:
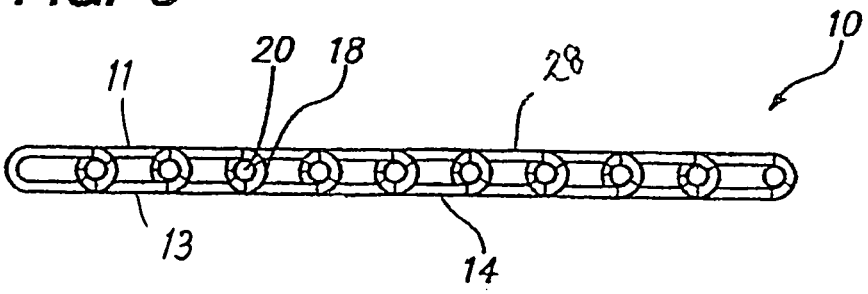
FIG. 3 is a right side elevational view of the architectural mesh panel of FIG. 1, the left side being a mirror image thereof.

A portion of an architectural mesh panel 10 (also referred to as mesh panel or panel hereafter) in accordance with an embodiment of the present invention is shown generally in FIGS. 1-3. The architectural mesh panel 10 comprises a woven mesh. However, the architectural mesh may include a combination of two or more different woven meshes. As shown in the illustrated embodiment, panel 10 has laterally opposing, i.e., left and right, vertically extending edges 12, 14, and is of indeterminate length in the longitudinal direction (parallel to the edges 12, 14). The panel 10 has a front or top side 11 and a rear or bottom side 13. In assembling the woven wire architectural mesh panel 10, a single helically-wound spiral wire, such as 16 in FIG. 1, is associated with two connector rods 20 positioned to be sequentially adjacent in the vertical direction of the architectural mesh panel 10 and to thereby define a spiral unit or row 16. The combination of a helically-wound spiral and two associated connector rods 20 defines a plurality of side-by-side open recesses or tunnels 28 extending in the transverse direction of the mesh panel 10.

Figure 4:
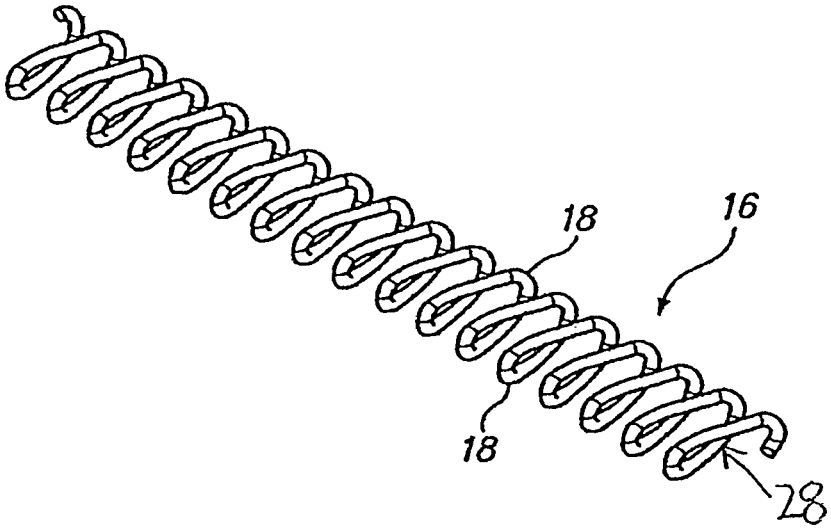
FIG. 4 is perspective view of a left-hand spiral before assembly into the architectural mesh panel shown in FIG. 1.
Figure 5:
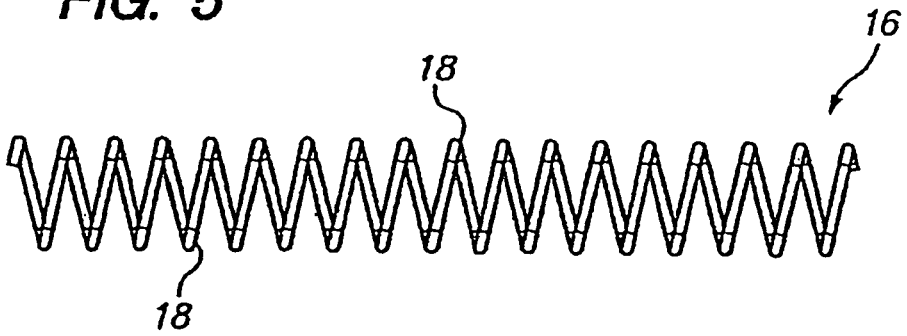
FIG. 5 is a top view of the left-hand spiral of FIG. 4.
Figure 6:
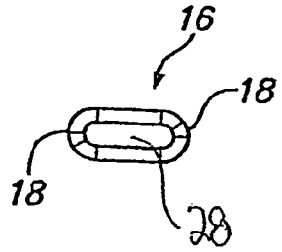
FIG. 6 is a right side elevational view of the left-hand spiral of FIG. 4, the left side being a mirror image thereof.
Figure 7:
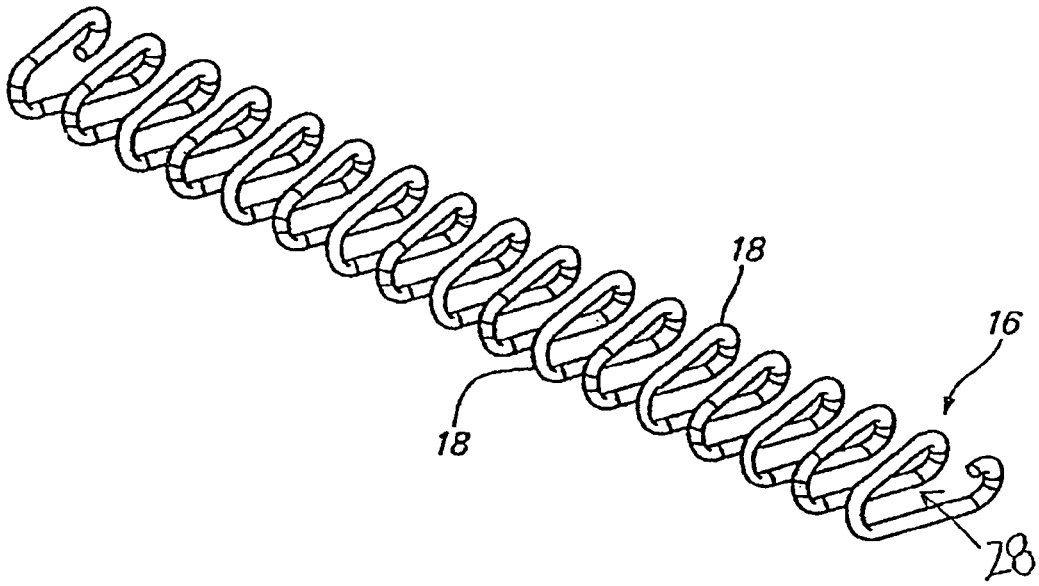
FIG. 7 is perspective view of a right-hand spiral before assembly into the architectural mesh shown in FIG. 1.

Architectural mesh panel 10 is composed of a longitudinally extending series of transversally extending flat spiral wire units 16, alternate ones of which spiral in a left-handed sense and a right-handed sense. FIGS. 4-6 illustrate a left-handed spiral and FIG. 7 illustrates a corresponding right-handed spiral in accordance with the present invention. The spiral units 16 are termed "flat spirals", because, looking at them endwise as shown best in FIGS. 3 and 6, they are not circular ring-shaped, but oval ring-shaped, because they have been "squashed" in a top-to-bottom thickness sense. That is, each spiral is wider (in the lengthwise direction of the mesh) than it is tall (in the direction of thickness of the mesh). The depth of the open recesses or tunnels 28 is thus defined in the direction of thickness direction of the mesh 10.

Figure 8:
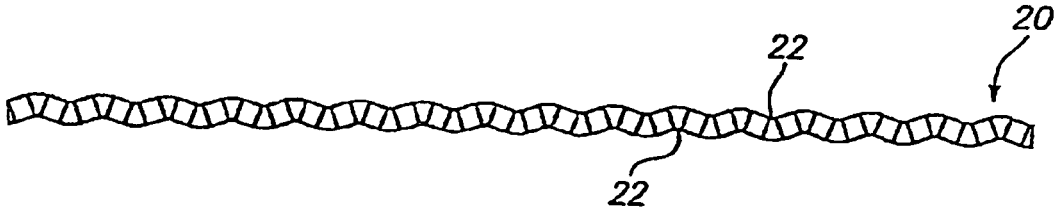
FIG. 8 is a top view of a connecting rod before assembly into the architectural mesh shown in FIG. 1.
Figure 9:
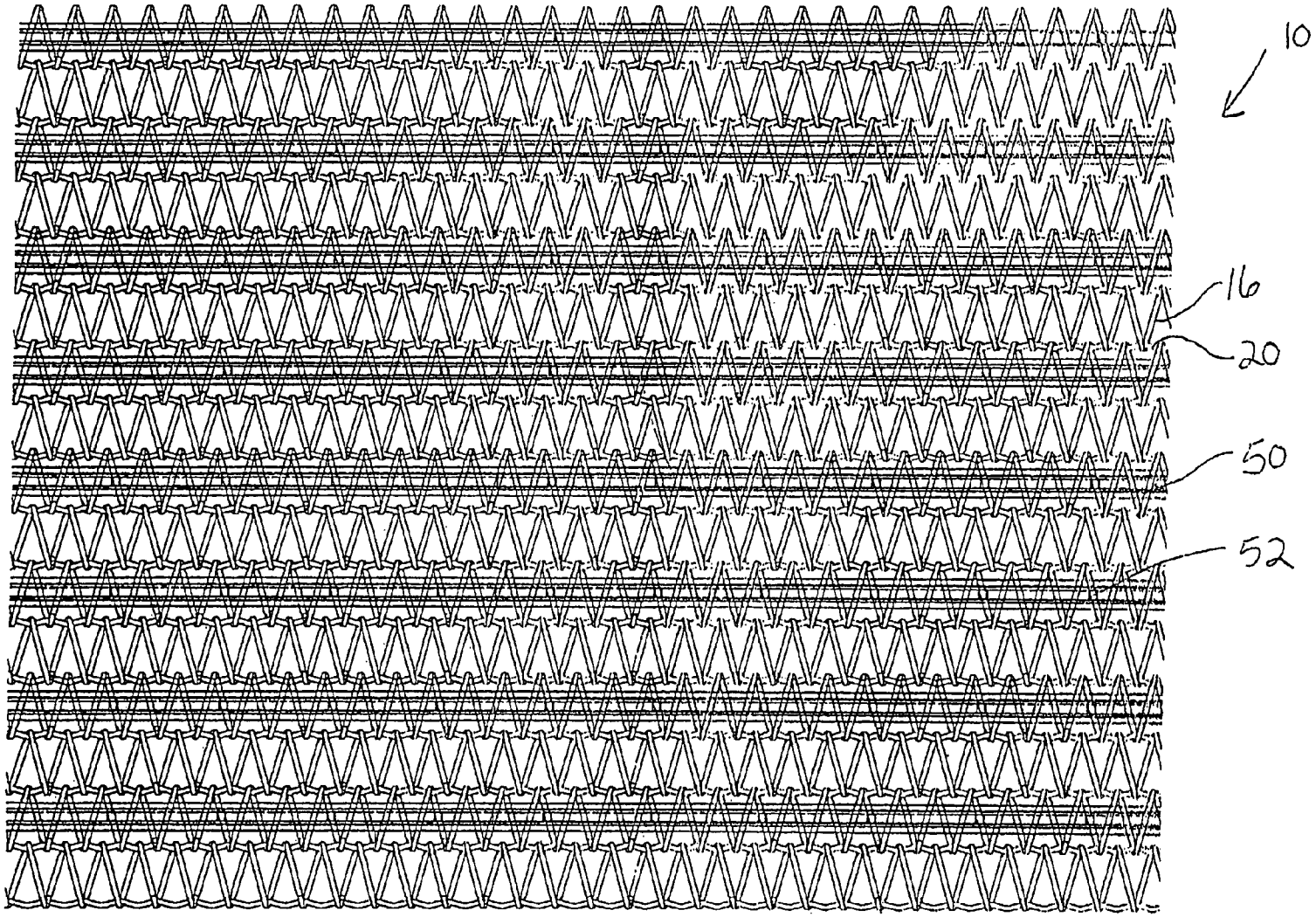
FIG. 9 is a top plan view of a section of the architectural mesh in accordance with the present invention.

Spiral turns 18 of the spiral units 16 turn around respective connecting rods 20, in respective crimp notches 22 in the rods 20. Referring to FIG. 8, the notches 22 face upwards and downwards, in the plane of the architectural mesh 10. The notches extend on axes which are not perpendicular to the plane of the mesh panel 10. Rather, on alternate ones of the rods 20, they are tilted to the left, and tilted to the right. On each rod, the notches 22 are provided in two series, one opening upwards, and another, diametrically opposed set, opening downwards. On each rod, the notches 22 of the two sets are staggered, one on one side being located half-way between two on the other side, but all are tilted in the same direction, i.e., all towards the left on both sides of one rod, and all towards the right on both sides of the next rod. Accordingly, spiral units 16 of opposite hand need to be wound in opposite directions, whereas crimp rods or connecting rods 20 can be manufactured as one type and simply alternately turned side to side in order to provide the two types needed.

FIG. 1 thus illustrates a "balanced" woven wire architectural mesh having vertically disposed alternate left-handed and right-handed helically-wound spirals in the height direction of the architectural mesh panel.

Typically, both the spiral wire units 16 and crimp rods 20 are manufactured from indeterminate lengths of steel wire material acquired as coils, and are not cut to length until after they have been provided with the above-described shapes as known in the art for forming woven wire products. The architectural mesh panel 10 may also be woven from a combination of spiral wire units of two or more different metals, for example, brass and stainless steel, a combination selected from stainless steel, aluminum, brass, bronze and copper, or the mesh may be woven using spiral wire units that are made from the same material. Similarly, all of the wires may be the same size or shape, or they may have different characteristics, such as, for example, different cross-sectional shapes.

Referring to FIG. 2, the balanced weave mesh of woven mesh 10 is known in the art as a B-24-12-12-14 mesh. The first number or count in this description refers to the spread, or loops/foot in the widthwise direction. The second number or count refers to the pitch, or spirals/foot, the third number refers to the wire gauge of the connecting rods, and the fourth number refers to the wire gauge from which the spiral units are formed. Although a specific weave of woven wire mesh has been described herein, the present invention is not limited to only the illustrated embodiment. It will be clear to one skilled in the art that a number of different mesh weaves could be assembled to achieve the desired aesthetic appeal.

Figure 10:
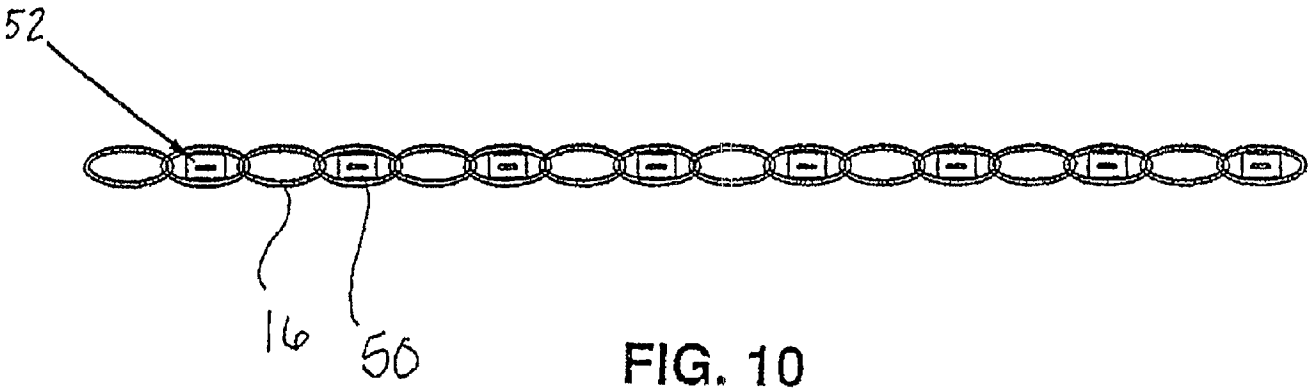
FIG. 10 is a side view of a section of the architectural mesh shown in FIG. 9.
Figure 11:
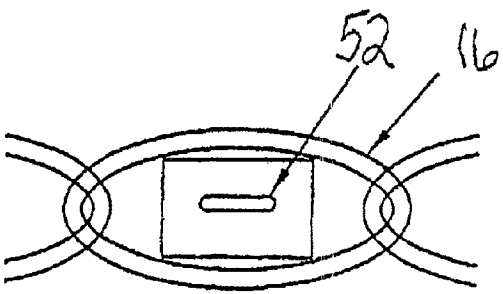
FIG. 11 is an enlarged, partial side view of a section of the architectural mesh shown in FIG. 9.
Figure 12:
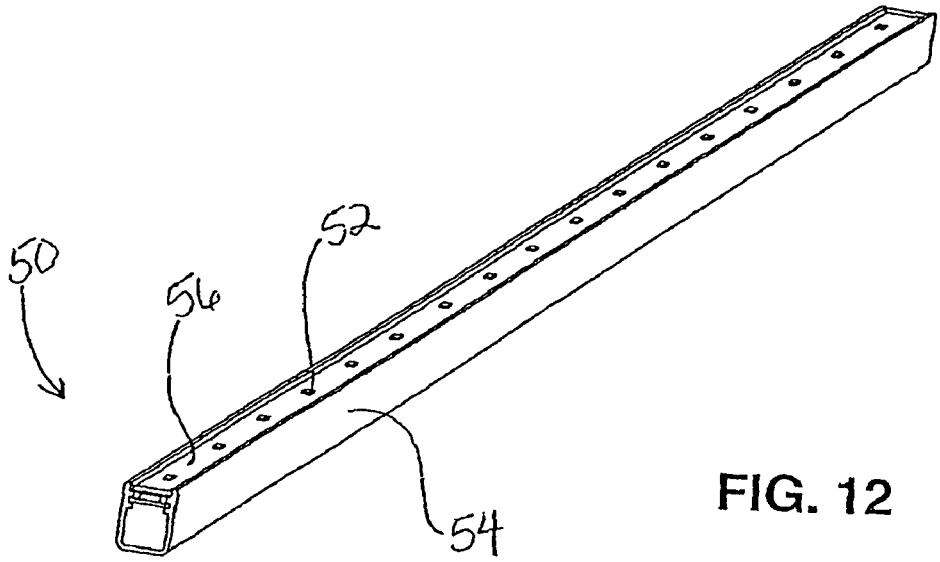
FIG. 12 is a perspective view of a preferred embodiment of a light tube disposed in the architectural mesh in accordance with the present invention.
Figure 13:
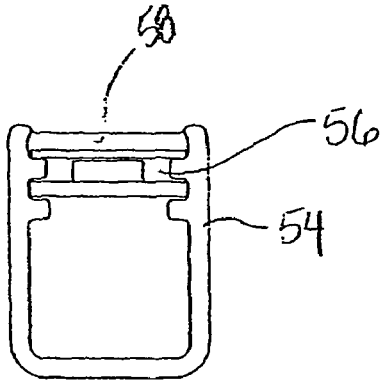
FIG. 13 is a side view of the light tube shown in FIG. 12.
Figure 14:
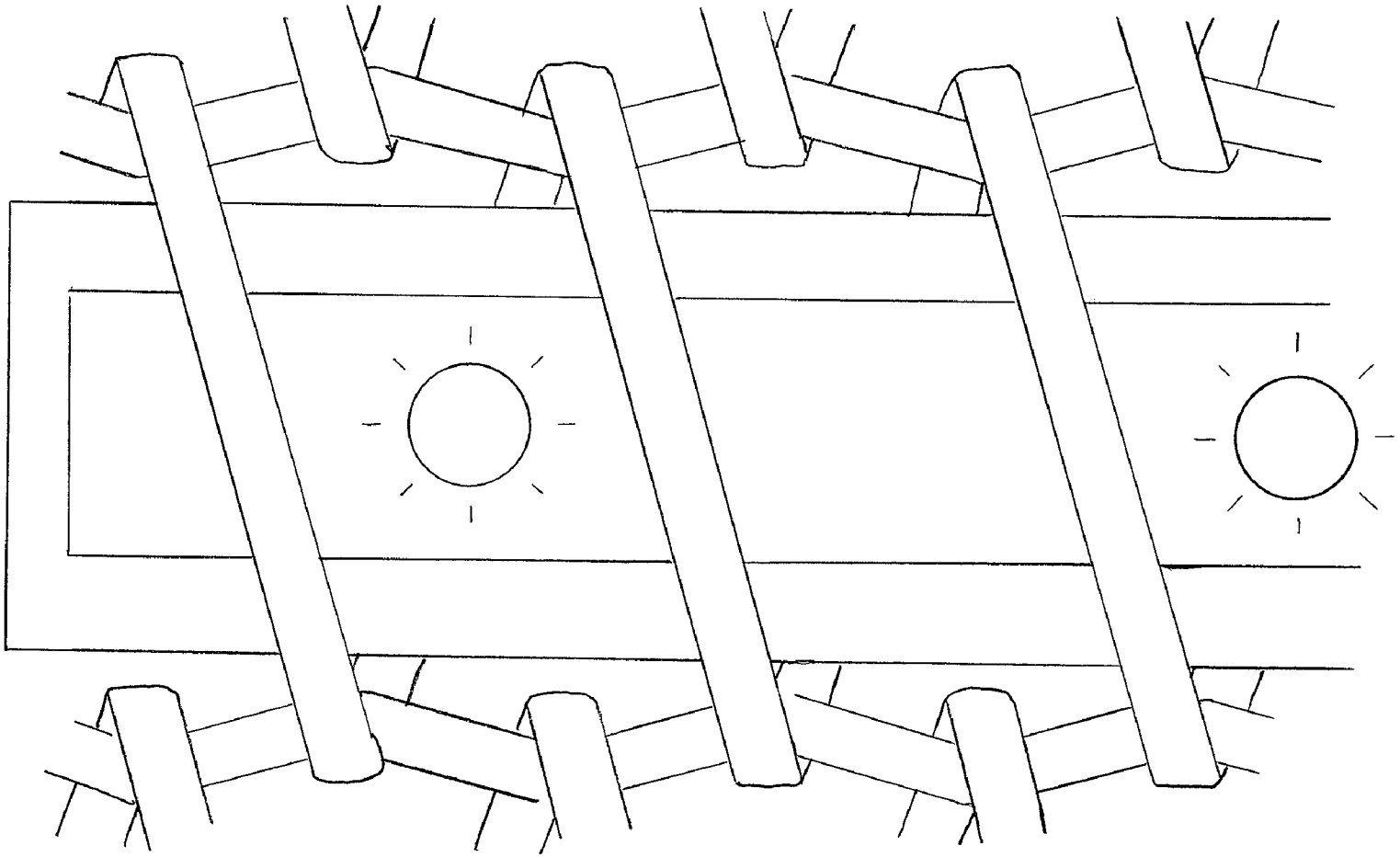
FIG. 14 is a partial enlarged view of the architectural mesh shown in FIG. 9.

The architectural mesh panel 10 further includes a light carrier or tube 50 capable of providing an accent light effect to the metallic mesh. As illustrated in FIGS. 9-11 and 14, the light tube 50 is slidably but securely disposed within the recesses or tunnels 28 of the woven mesh 10 after the mesh is fully assembled. Hence, when the architectural mesh panel 10 is fastened to a building, it is possible to create a large lighted display by inserting the light tubes 50 therein. As shown in FIG. 10, the mesh has a uniform thickness over its entire length because the light tube 50 fits into any of the recess or tunnels 28 in each of the spiral wire units 16. Stated another way, each of the spiral units 16, whether occupied or unoccupied by a light tube 50, has the same thickness dimension such that the thickness of the mesh 10 is uniform.

Figure 15:
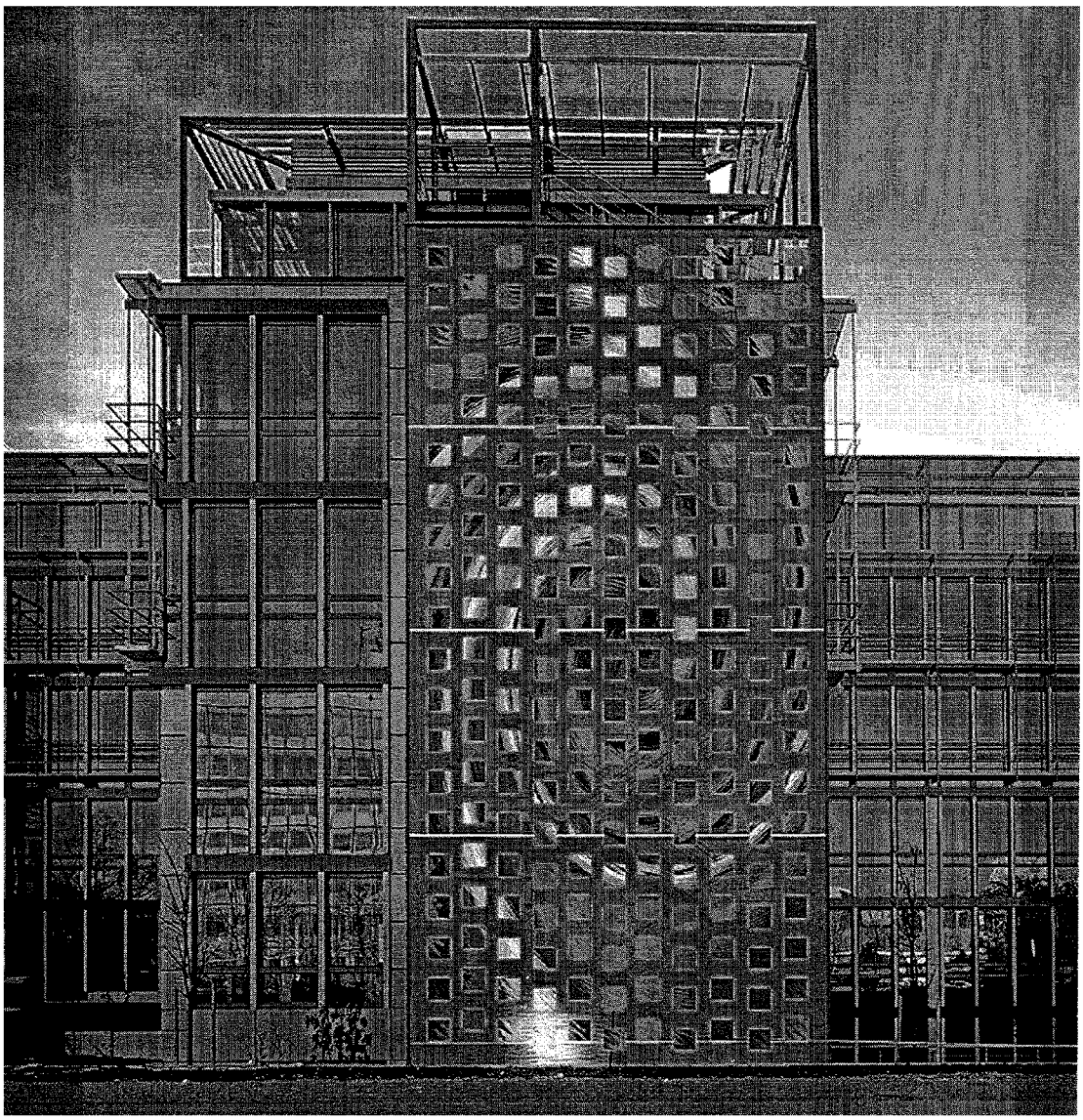
FIG. 15 is a schematic illustration of the architectural mesh applied to a building structure.

Each light tube 50 preferably comprises a unitary member housing a plurality of light elements 52 extending along the length thereof. More specifically, a preferred embodiment of the light tube includes a U-shaped channel 54 and a printed circuit board 56 fitted therein, the printed circuit board including the plurality of light elements 52. A transparent sheet 58 may be disposed on the top surface of the light tube 50 to protect the enclosed light elements 52. An example of such a light tube 50 is the VERSA Ray LED unit available from Element Labs, Inc. of Austin, Tex. The light-emitting diode (LED) of any desired color is used to create the desired light effect. The LEDs may be powered by one or more batteries, and maybe configured for either continuous power or flashing on and off for longer life. Still further, the LEDs may be used to create a picture, logos, wording, or even a continuously moving video, as shown in FIG. 15. The present invention is not limited to the size or shape of the light tube 50 shown in the figures, it being clear one skilled in the art that various sizes and shapes can be used depending upon the size of the recess 28 formed by the woven mesh 10.

After formation of the woven mesh 10, a plurality of light tubes 50 are disposed within the recesses to form the finished product. The woven mesh 10 with the light tube 50 already therein can be rolled-up similar to a roller shade until time of installation. During installation, the woven mesh 10 is hung from a building using a hanger of any known type, such as for example, that disclosed in U.S. Patent Publication Nos. 2006/0075699 or 2006/0090862. As shown in FIG. 15, the woven mesh 10 with the light tubes 50 creates a dynamic facade for the exterior of a building.

Figure 16:
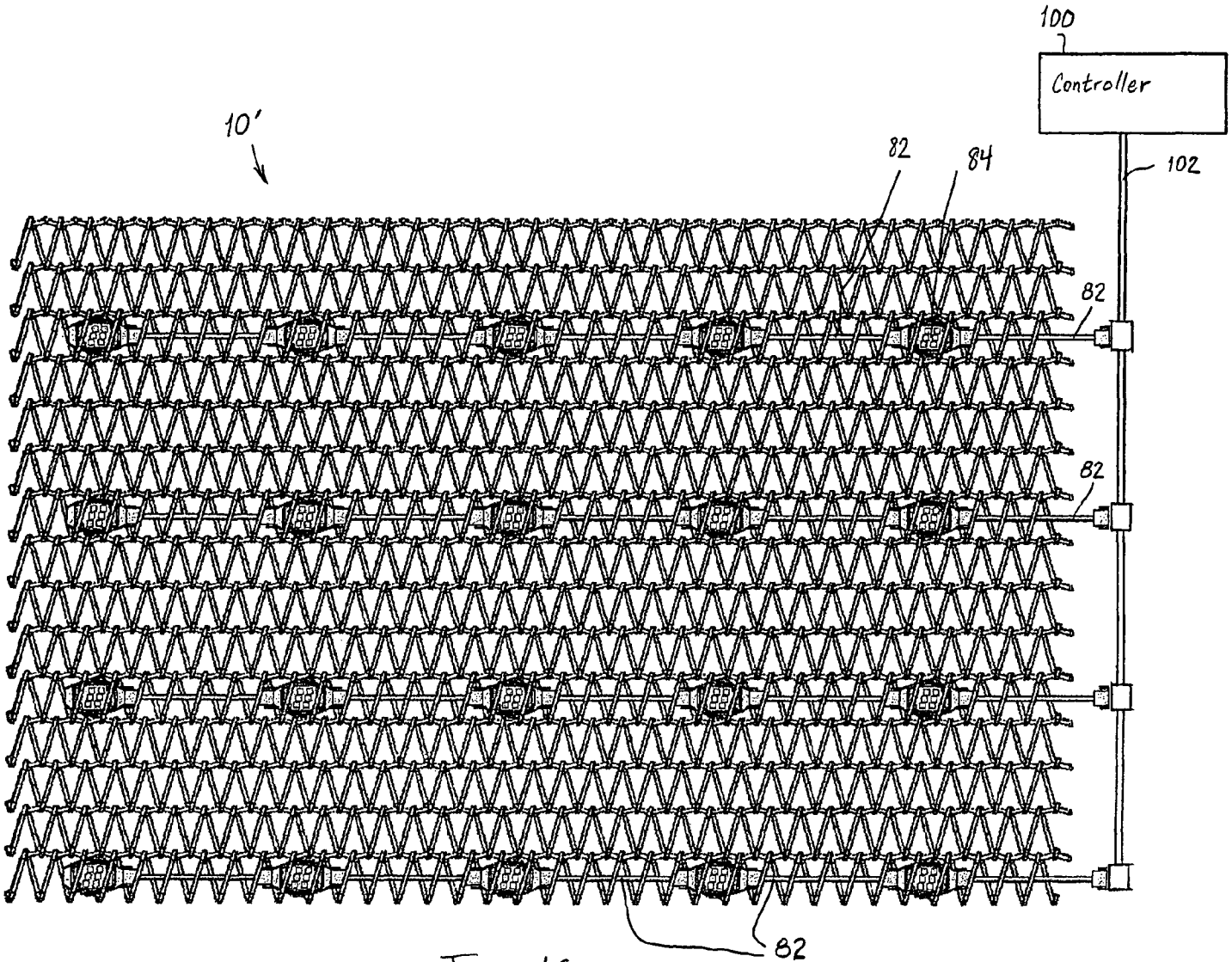
FIG. 16 is a top plan view of a section of an architectural mesh according to another embodiment of the present invention.
Figure 17:
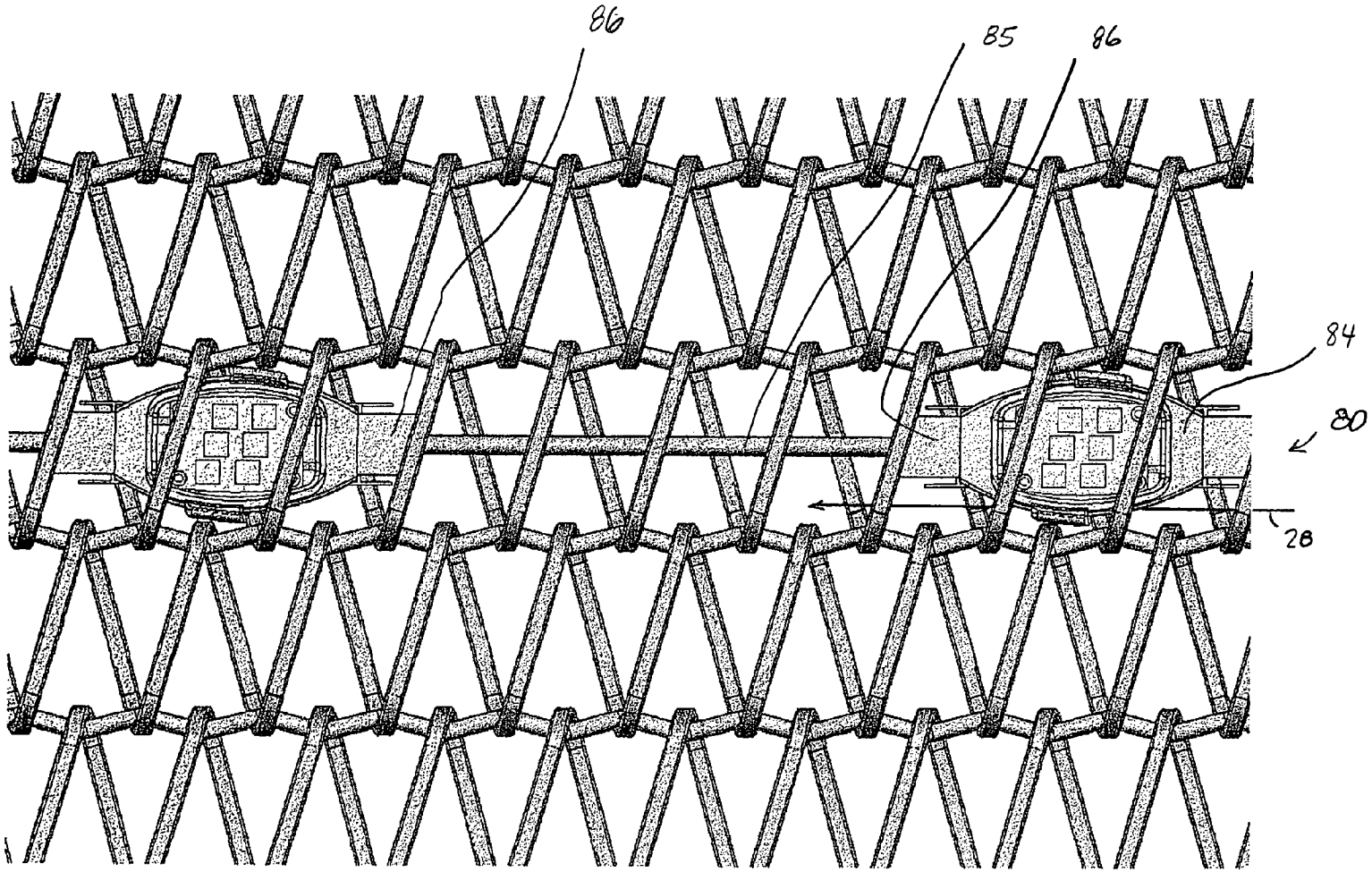
FIG. 17 is a top plan view of a smaller section of the mesh of FIG. 16.

FIGS. 16 and 17 show a further embodiment of the present invention in which a plurality of light carriers 80 of series-connected LED nodes 84 are respectively inserted into recesses or tunnels 28 in an architectural mesh panel 10'. The LED nodes 84 are arranged in an array to produce an integrated video display that is viewable in all sunlight conditions and maximizes transparency (i.e., maximizes visibility through the mesh). As described below, the light carriers 80 allow for maximum flexibility in horizontal and vertical placement of specific LED pixels. Similarly to the above mesh panel 10, the mesh panel 10' of FIGS. 16 and 17 has a uniform thickness. Thus, the embodiment of FIGS. 16-18 may be retrofitted on current installations and future installations.

Each light carrier 80 includes a series of the LED nodes 84 interconnected by cable connectors 82. The LED nodes 84 are oval-shaped to facilitate insertion and removal from the recesses or tunnels 28 in the mesh 10'. The oval shape of the LED nodes further minimizes the visual obstruction and therefore maximizes visibility through the mesh 10'. Although an oval shape is preferred, the LED nodes 84 may have any shape that fits into the recess or tunnels 28. The mesh 10' provides a cosmetic and functional enclosure for the LED nodes 84 in that the mesh 10' shields the LED nodes 84 from environmental factors such as hail and airborne particles.

Each cable connector 82 in the light carrier 80 includes a cable 85 and two connectors 86 arranged on the opposing ends of the cable 85. The cables 85 may exhibit some flexibility but have sufficient rigidity so that the strand may be fed through the recess or tunnel 28 from one end of the mesh 10'. The connectors 86 are plugs which plug into sockets arranged on the LED nodes 84. Alternatively, the connectors 86 may comprise sockets and the LED nodes 84 could have plugs. The plug and socket connection eliminates field wiring concerns and facilitates field connections of the components and replacement of broken or damaged components. More specifically, the use of cable connectors 82 and nodes 84 allows individual nodes 84 of a light carrier 80 to be replaced without replacing the entire light carrier. As shown on the right side in FIG. 16, each light carrier 80 has a single connection to a control bus 102 which powers and controls each LED pixel 88. The control bus 102 is connected to a central controller 100 which coordinates illumination of each of the LED pixels 88 to produce a dynamic image. The controller 100 and control bus 102 may use any known or hereafter developed signal protocol for individually addressing each LED pixel 88. Furthermore, the configuration of the connection to the control bus 102 is not limited to the connection shown in FIG. 16. Any known connection configuration may be used such as, for example, ring or star connections.

The cable connectors 82 can be manufactured in a plurality of lengths so that the horizontal distance, i.e., horizontal spacing, between each adjacent pair of LED nodes 84 in each light carrier 80 can be set to a desired pitch by using the appropriate cable connector length. The vertical spacing between light carriers 80 is determined by selecting the appropriate recesses or tunnels 28 in which the light carriers 80 are inserted. Because the cables 85 are relatively thin, the embodiment of FIGS. 16-18 minimizes the visual obstruction through mesh 10'. That is, the transparency through the recess or tunnel 28 occupied by a light strand is only partially occluded by the light carrier 80. Thus, the embodiment of FIGS. 16-18 is completed within the thickness of the mesh 10' and does not alter characteristics or the structure of the mesh 10'.

Figure 18:
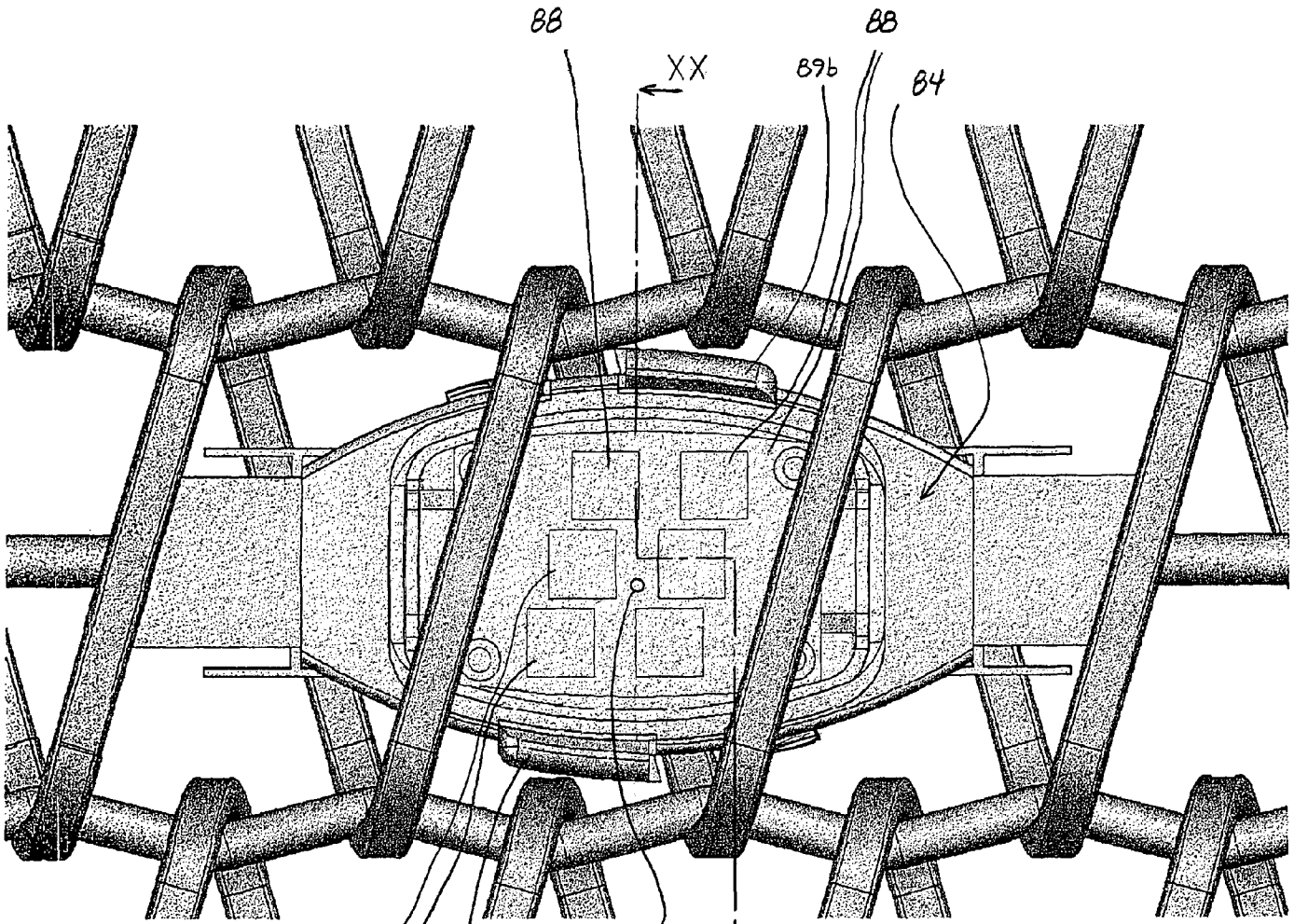
FIG. 18 is an enlarged view of one light node of the architectural mesh of FIG. 16.

As shown in FIG. 18, a cluster of six LED pixels 88 are arranged on the LED node 84 in a parallelogram pattern which matches the interstices in mesh panel 10' so that the unobstructed light output from the system is maximized. This pattern of LED pixels 88 is designed for the interstices of a left-handed spiral which is shown in FIGS. 4-6. Although six LED pixels 88 are used in the present embodiment, the cluster may comprise one or more of the LED pixels arranged in each LED node 84. Since parallelogram pattern of the LED pixels 88 is designed for a left-handed spiral, the architectural mesh 10' of FIGS. 16-18 includes only left-handed spirals. Alternatively, the mesh 10 of FIGS. 1 and 2 described above which includes alternating left hand and right hand spirals may also be used. In this case, care must be taken to ensure that the light carriers 80 are inserted in the left-handed spirals. Alternatively or additionally, LED nodes 84 may be produced which match the interstices of right-handed spirals. Although LEDs are used in the described embodiment, the light emitting nodes may include any known or hereafter developed light source.

The use of a cluster of, for example, six LED pixels 88 in one LED node increases the light output such that the light output may be viewed in direct sunlight. In addition, a light or brightness sensor 87 may be arranged in one or more of the LED nodes 84. Using the brightness sensor 87, the controller 100 monitors the ambient light and controls the number of LED pixels 88 in the cluster of LED pixels in an LED node 84 that are illuminated based on the brightness. For example, all six LED pixels 88 are illuminated in direct sunlight and one LED pixel 88 of the six LED pixels is illuminated at night. It is possible to install a brightness sensor 87 on each LED node so that each LED node 84 is individually controlled for brightness. This can be helpful when a shadow covers part of the mesh panel 10, 10'. Instead of being arranged on the LED nodes 84, the brightness sensors may be arranged at different locations on the mesh panel as separate elements connected to the control bus 102.

Figure 19:
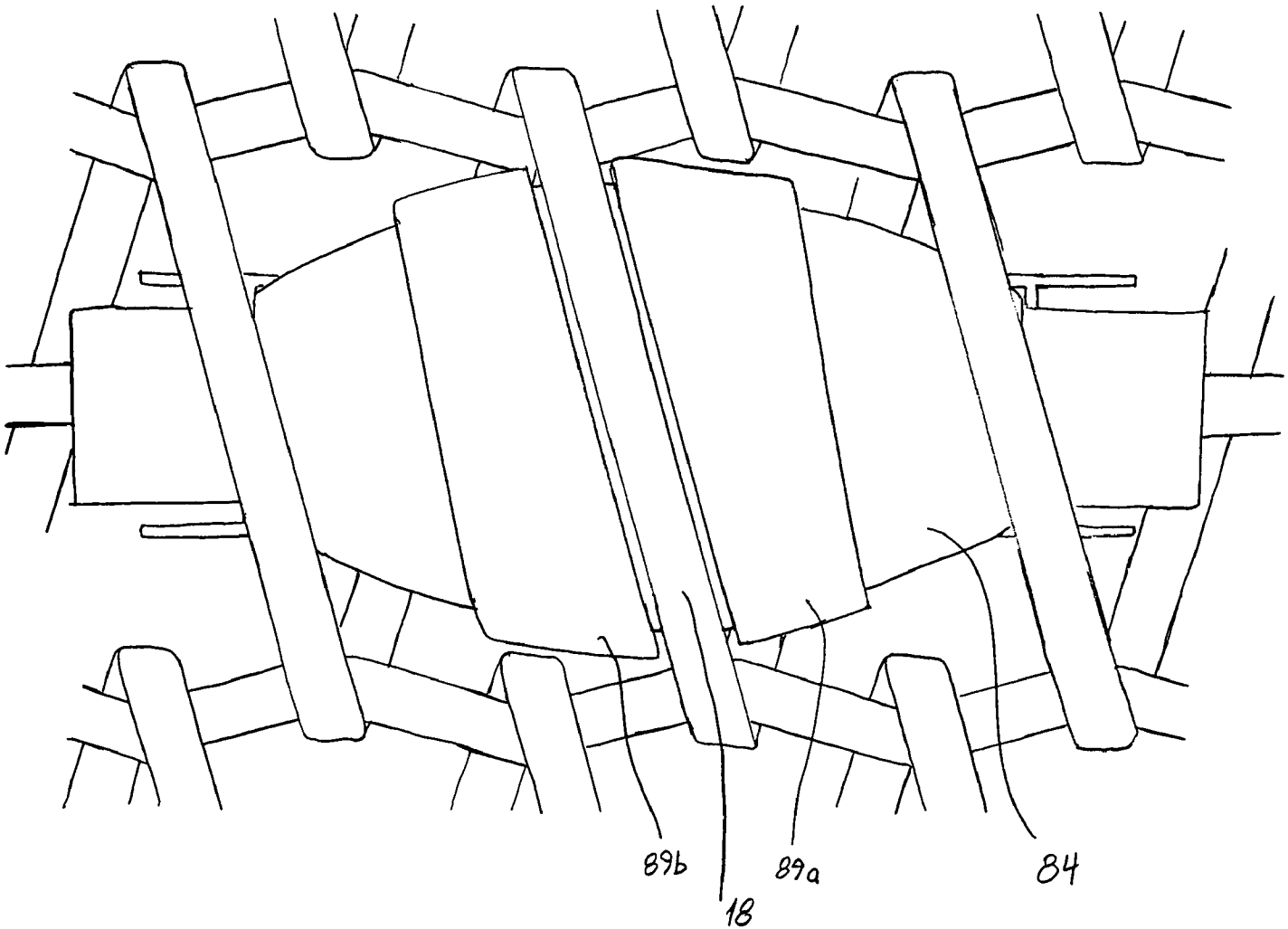
FIG. 19 is a bottom view of the light node of FIG. 18 in the architectural mesh showing the clips.
Figure 20:
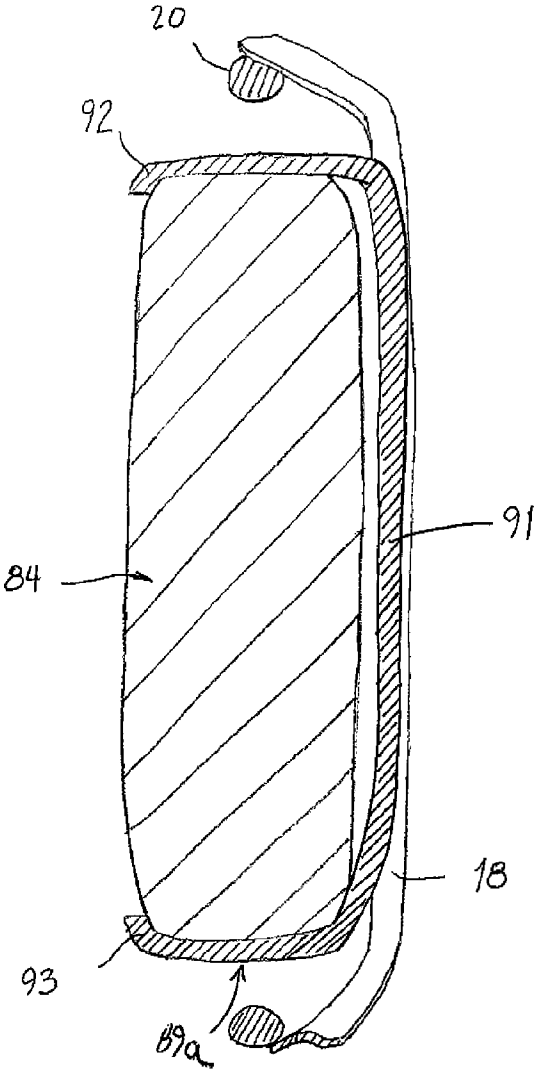
FIG. 20 is a sectional side view of the light node of FIG. 18.

As further shown in FIGS. 18-20, attachment clips 89*a*, 89*b* may be attached to the LED modules 84 post installation to hold the LED modules 84 in place relative to the mesh 10'. As shown in FIG. 20, the clips 89*a*, 89*b* may comprise C-shaped clips that extend around the back of the LED module 84. The ends 92, 93 of the C-shaped clip are held onto the upper and lower edges of the LED module 84 and the center section 91 of the C-shaped clips 89*a*, 89*b* comprise stops arranged on either side of the wire 16 in the back of the LED module 84 to prevent lateral movement of the LED module 84 in the mesh 10' post installation. The attachment clips 89*a*, 89*b* may be made from metal, metal alloys, or plastics and are designed to be tamper resistant. In one embodiment, the attachment clips 89*a*, 89*b* must be broken or destroyed to be removed to thereby inhibit removal. As shown in FIGS. 19-20, the clips 89*a*, 89*b* maintain the lateral position of the LED module 84 and simultaneously are arranged within the thickness of the architectural mesh 10' so that the uniform thickness of the mesh is maintained.

Although the LED pixels 88 are shown on only one side of the mesh 10', the LED pixels 88 may be arranged to be viewed from both sides of the mesh 10'. This can be accomplished in two ways. The LED nodes 84 may alternately face the two opposing sides of the mesh or each of the LED nodes 84 may be arranged with pixels on both sides.

While the present invention has been described with respect to a particular embodiment of the present invention, this is by way of illustration for purposes of disclosure rather than to confine the invention to any specific arrangement as there are various alterations, changes, deviations, eliminations, substitutions, omissions and departures which may be made in the particular embodiments shown and described without departing from the scope of the present invention. Furthermore, parts of one embodiment may be used in other embodiments.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An architectural mesh, comprising:

a mesh panel comprising a plurality of interconnected wires and having opposing front and rear sides and transverse openings, said mesh panel being an open mesh having interstices between said interconnected wires on said front and rear sides, wherein said interconnected wires of said mesh panel comprise helically wound spiral wires, each of said transverse openings comprising an opening along a longitudinal axis of said spiral wires; and at least one light carrier slideably received in one of said transverse openings, said at least one light carrier having a plurality of light emitter elements emitting light through said interstices in said mesh panel on at least one of the front and rear sides.

2. The architectural mesh of claim 1, wherein said at least one light carrier further comprises a plurality of nodes releasably connected by a plurality of connecting elements, wherein each of said plural nodes comprises at least one of said plurality of light emitter elements.

3. The architectural mesh of claim 2, wherein each of said connecting elements comprises at least one electrical conductor and two connectors arranged on opposing ends of said at least one electrical conductor, each of said connectors being releasably connectable to one of said nodes.

4. The architectural mesh of claim 3, wherein each of said connecting elements of said at least one light carrier is separately replaceable.

5. The architectural mesh of claim 3, wherein each of said nodes of said at least one light carrier is separately replaceable.

6. The architectural mesh of claim 2, wherein each of more than one of said plural nodes comprises a plurality of said plural light emitting elements.

7. The architectural mesh of claim 6, wherein said plural light emitter elements in each of the more than one node are arranged in an identical spatial pattern.

8. The architectural mesh of claim 1, wherein first sections of the at least one light carrier between the light emitter elements have a thinner profile than second sections of the at least one light carrier including the light emitting elements, such that visibility through the mesh is occluded less by the first sections than by the second sections.

9. The architectural mesh of claim 1, wherein said mesh panel has a uniform thickness.

10. The architectural mesh of claim 1, wherein the mesh panel is not part of a control circuit or a power circuit for the at least one light carrier.

11. An architectural mesh, comprising:

a mesh panel of interconnected wires having opposing front and rear sides and transverse openings, said mesh panel being an open mesh having interstices between said interconnected wires on said front and rear sides; and at least one light carrier slideably received in one of said transverse openings, said at least one light carrier having a plurality of light emitter elements emitting light through said interstices in said mesh panel on at least one of the front and rear sides, wherein at least one of said light emitter elements corresponds to one of said interstices.

12. The architectural mesh of claim 11, wherein said each of said light emitter elements comprises a light emitting pixel.

13. The architectural mesh of claim 12, wherein each of said plural light emitting pixels comprises a Light Emitting Diode.

14. The architectural mesh of claim 11, wherein said at least one light carrier comprises a plurality of nodes, each of said plural nodes comprising at least one of said light emitter elements.

15. The architectural mesh of claim 14, wherein each of said nodes is oval-shaped.

16. The architectural mesh of claim 14, wherein each of more than one of said nodes comprises more than one of said light emitter elements, and said more than one said light emitter elements form an identical spatial pattern on said each of more than one of said nodes.

17. The architectural mesh of claim 14, further comprising at least one stop coupled to at least one of said nodes for preventing lateral movement of said at least one node relative to said mesh panel.

18. The architectural mesh of claim 11, wherein said interconnected wires of said mesh panel comprise helically wound spiral wires and each of said transverse openings comprises an opening along a longitudinal axis of said spiral wires.

19. The architectural mesh of claim 18, wherein each of said helically wound spiral wires includes a plurality of turns, and said interstices on said front and rear sides of said mesh panel are formed between said turns of said each of said spiral wires.

20. The architectural mesh of claim 11, further comprising at least one stop coupled to at least one of said light carriers for preventing lateral movement of said at least one light carrier relative to said mesh panel.

21. The architectural mesh of claim 11, wherein the at least one light carrier further comprises at least one brightness sensor configured to sense an ambient brightness, wherein the number of said plural light emitter elements illuminated on said at least one light carrier is dependent on the ambient brightness sensed by said at least one brightness sensor.

22. The architectural mesh of claim 11, wherein said one of the transverse openings into which the at least one light carrier was slideably received is one of a plurality of identical transverse openings formed by the interconnected wires that form said mesh panel at a side of said mesh panel.

23. The architectural mesh of claim 11, wherein a plurality of said plural light emitter elements are arranged in one or more repeating spatial patterns along said at least one light carrier.

24. The architectural mesh of claim 23, wherein at least one of said one or more spatial patterns is a parallelogram shape.

25. An architectural mesh, comprising:

a mesh panel comprising a plurality of interconnected wires and having opposing front and rear sides and transverse openings, said mesh panel being an open mesh having interstices between said interconnected wires on said front and rear sides; and at least one light carrier slideably received in one of said transverse openings, said at least one light carrier comprising:

a plurality of nodes, each node comprising at least one of a plurality of light emitter elements emitting light through said interstices in said mesh panel on at least one of the front and rear sides; and a plurality of connecting elements, wherein each of said plural nodes is releasably interconnected by said connecting elements; and at least one C-shaped clip coupled to the mesh panel for preventing lateral movement of at least one of said plural nodes relative to said mesh panel, each said at least one C-shaped clip having two ends and a center section between said two ends, said two ends being connectable to a top and bottom of said at least one of said plural nodes, said center of said at least one C-shaped clip being arranged laterally adjacent a section of one of said wires of said mesh panel such that the lateral movement is prevented by interference between said center section and said section of one of said wires.

26. A method of making an architectural mesh into a visible display, said mesh comprising an open mesh panel of interconnected wires forming interstices visible from the front and rear of said mesh panel, comprising the step of:

inserting at least one light carrier into a transverse opening formed by the interconnected wires that form the mesh panel at a side of said mesh panel, said transverse opening being one of a plurality of identical transverse openings formed in the side of said mesh panel by the interconnected wires comprising said mesh panel, the at least one light carrier having light emitter elements arranged to emit light through the interstices on at least one of the front and rear of the mesh panel.

27. The method of claim 26, further comprising the step of:

assembling the at least one light carrier by interconnecting nodes having at least one of said light emitter elements with connecting elements, wherein each of the nodes is releasably connected to at least one of the connecting elements.

28. The method of claim 27, wherein more than one of said nodes has more than one of said plural light emitter elements, and said more than one light emitter element on each of said more than one node forms an identical spatial pattern that corresponds to a shape of the interstices through which light is to be emitted.

29. A method of making an architectural mesh into a visible display, said mesh comprising an open mesh panel of interconnected wires forming interstices visible from the front and rear of said mesh panel, comprising the steps of:

assembling at least one light carrier comprised of a plurality of nodes releasably connected by a plurality of connecting elements, each one of said plural nodes having at least one of a plurality of light emitter elements, wherein said step of assembling comprises:

determining a required length between adjacent nodes such that each of said nodes is aligned with one of the interstices of said mesh panel;

selecting connecting elements having said determined required length; and interconnecting the nodes with the selected connecting elements; and inserting the assembled at least one light carrier into a transverse opening at a side of said mesh panel, said transverse opening being one of a plurality of identical transverse openings formed in the side of said mesh panel by the interconnected wires comprising said mesh panel.

30. The method of claim 29, wherein the step of selecting connecting elements having said determined required length comprises:

selecting said connecting elements from a plurality of prefabricated connecting elements having a variety of predetermined lengths, said predetermined lengths selected so that the plural nodes can be aligned with panel meshes having differently-formed interstices.

31. The method of claim 29, wherein the step of selecting connecting elements having said determined required length comprises:

forming said connecting elements having said determined required length.

32. A method of making an architectural mesh into a visible display, said mesh comprising an open mesh panel of interconnected wires forming interstices visible from the front and rear of said mesh panel, comprising the step of:

inserting at least one light carrier into a transverse opening at a side of said mesh panel, said transverse opening being one of a plurality of identical transverse openings formed in the side of said mesh panel by the interconnected wires comprising said mesh panel, the at least one light carrier comprising light emitter elements;

wherein a control system controlling said at least one light carrier determines, by a brightness sensor, the brightness of ambient light at the mesh panel and controls a number of the light emitter elements in said at least one light carrier to be illuminated based on the determined brightness of the ambient light.

33. A method of making an architectural mesh into a visible display, said mesh comprising an open mesh panel of interconnected wires forming interstices visible from the front and rear of said mesh panel, comprising the steps of:

inserting at least one light carrier into a transverse opening at a side of said mesh panel, said transverse opening being one of a plurality of identical transverse openings formed in the side of said mesh panel by the interconnected wires comprising said mesh panel, the at least one light carrier comprising light emitter elements; and attaching a stop element to the at least one light carrier after said step of inserting to prevent further lateral movement of the at least one light carrier, the stop element being arranged within a thickness of the mesh.

34. An architectural mesh, comprising:

a mesh panel comprising a plurality of interconnected wires and having opposing front and rear sides and transverse openings, said mesh panel being an open mesh having interstices between said interconnected wires on said front and rear sides; and at least one light carrier slideably received in one of said transverse openings, said at least one light carrier having a plurality of nodes having a plurality of light emitter elements emitting light through said interstices in said mesh panel on at least one of said front and rear sides, said at least one light carrier further comprising connecting elements, said plurality of nodes of said at least one light carrier being releasably interconnected in series by said connecting elements, each of said connecting elements comprising at least one electrical conductor and two connectors arranged on opposing ends of said at least one electrical conductor, each one of said connectors being releasably connectable to one of said plurality of nodes, whereby each of said connecting elements and each of said plurality of nodes of said at least one light carrier is separately replaceable, and wherein said connecting elements of said at least one light carrier have a thinner profile than said nodes of said at least one light carrier, such that visibility through said mesh panel is occluded less by said connecting elements than by said nodes.

35. The architectural mesh of claim 34, wherein the mesh panel is not part of a control circuit or a power circuit for the at least one light carrier.

36. A visual display system using an architectural mesh, comprising:

a mesh panel comprising a plurality of interconnected wires and having opposing front and rear sides and transverse openings, said mesh panel being an open mesh having interstices between said interconnected wires on said front and rear sides, wherein said interconnected wires of said mesh panel comprise helically wound spiral wires, each of said transverse openings comprising an opening along a longitudinal axis of said spiral wires; and at least one light carrier slideably received in one of said transverse openings, said at least one light carrier having a plurality of light emitter elements emitting light through said interstices in said mesh panel on at least one of the front and rear sides.

37. A visual display system, comprising:

an open mesh panel of interwoven wires, wherein a plurality of identical interstices are formed by said interwoven wires in the open mesh panel, and wherein a plurality of identical tunnels are formed in parallel by said interwoven wires in the open mesh panel, each of said identical plural tunnels extending transversely across said open mesh panel and having opposing ends that are open at opposite sides of said open mesh panel; and a plurality of light carriers, each of which can be slideably received in any one of said identical plural tunnels through either of the opposing ends of the one of said identical plural tunnels, each of said plural light carriers having a plurality of light emitter elements;

wherein, when any one of said plural light carriers is slidably received into one of said plural identical tunnels through one of said open opposing ends, light emitted from plural light emitter elements on the slidably received light carrier is visible through said plural identical interstices from at least one of a front and rear of said open mesh panel;

whereby a plurality of said plural light carriers slidably received into a plurality of said plural identical tunnels form at least one visual display on at least one of the front and rear of said open mesh panel.

38. The visual display system of claim 37, wherein each of said plural light carriers comprises:

a plurality of nodes holding the plural light emitter elements; and a plurality of connecting wires, each of which can be releasably connected to each of said plural nodes and each of which, when connected, can transmit electrical power and/or signals to or from the connected node;

wherein each of said plural light carriers is formed by connecting said nodes and connecting wires in series, whereby light carriers of various lengths may be formed and whereby electrical power and/or signals can be transmitted to and from the nodes forming the light carrier.

* * * * *